US006752717B2

(12) United States Patent
Vancura

(10) Patent No.: US 6,752,717 B2
(45) **Date of Patent: *Jun. 22, 2004**

(54) METHODS OF TEMPORAL KNOWLEDGE-BASED GAMING

(75) Inventor: Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 117 days.

This patent is subject to a terminal disclaimer.

(21) Appl. No.: 10/155,597

(22) Filed: May 24, 2002

(65) Prior Publication Data

US 2002/0187824 A1 Dec. 12, 2002

Related U.S. Application Data

(63) Continuation of application No. 09/616,724, filed on Jul. 14, 2000, now Pat. No. 6,413,160, which is a continuation-in-part of application No. 09/372,560, filed on Aug. 11, 1999.

(60) Provisional application No. 60/099,959, filed on Sep. 11, 1998.

(51) Int. Cl.[7] ..... A63F 9/24

(52) U.S. Cl. ..... 463/16; 20/25

(58) Field of Search ..... 463/16, 17, 18, 463/19, 20, 7, 8; 273/432, 445, 143 R, 138.1, 138.2, 139, 138 A; 434/322, 323, 327, 332, 335, 350, 352

(56) References Cited

U.S. PATENT DOCUMENTS

| | | | | |
|---|---|---|---|---|
| 2,835,052 | A | * | 5/1958 | Raich et al. |
| 4,836,546 | A | * | 6/1989 | DiRe et al. |
| 5,035,625 | A | * | 7/1991 | Munson et al. |
| 5,178,545 | A | * | 1/1993 | Thompson |
| 5,286,036 | A | * | 2/1994 | Barabash |
| 5,718,429 | A | * | 2/1998 | Keller, Jr. |
| 6,193,606 | B1 | | 2/2001 | Walker et al. |

FOREIGN PATENT DOCUMENTS

| | | | |
|---|---|---|---|
| GB | 2072395 | * | 9/1981 |
| GB | 2083936 | * | 3/1982 |
| GB | 2 087 618 A | | 5/1982 |
| GB | 2 066 991 A | | 7/1982 |
| GB | 2 167 676 A | | 6/1986 |
| GB | 2 184 029 A | | 6/1987 |
| GB | 2 185 612 A | | 7/1987 |
| GB | 2 188 182 A | | 9/1987 |
| GB | 2197974 | * | 6/1988 |
| GB | 2 201 822 A | | 9/1988 |
| GB | 2 207 268 A | | 1/1989 |
| GB | 2217500 | * | 10/1989 |
| GB | 2 253 569 A | | 9/1992 |
| GB | 2 262 642 A | | 6/1993 |
| GB | 2 292 246 A | | 2/1996 |
| GB | 2320206 | * | 6/1998 |

OTHER PUBLICATIONS

NTN Programming Informational Materials, Jun. 1990.*
Slots of Trivia Informational Materials, Aug. 1996.*
Regulations of the Nevada Gaming Commission, Carson City, Nevada, Nov. 1998 pp. 953–954.
Butterworths Annotated Legislation Service, Statutes Supplement No. 171, The Gaming Act 1968, Eddy and Loewe, London, 1969, pp. 209–212.
Machine Guidelines Jul. 99, www.gbgb.org.uk/consol.htm, Feb. 7, 2001, pp. 1–11.

* cited by examiner

*Primary Examiner*—Michael O'Neill
(74) *Attorney, Agent, or Firm*—Dorr, Carson, Sloan, Birney & Kramer, P.C.

(57) ABSTRACT

Providing, in a casino game, a time period for a player to provide a response to a query presented in the casino game or in a bonus game to the casino game. Paying a higher award for a correct response and a lower award for an incorrect response when the player answers within the time period. When no response is received, randomly choosing a response and paying the player based on the correctness of the response.

10 Claims, 1 Drawing Sheet

METHODS OF TEMPORAL KNOWLEDGE-BASED GAMING

PRIORITY CLAIM

This application is a Continuation of Ser. No. 09/616,724 filed Jul. 14, 2000, now U.S. Pat. No. 6,413,160, entitled "METHODS OF TEMPORAL KNOWLEDGE-BASED GAMING" which is a Continuation-In-Part of U.S. application Ser. No. 09/372,560, filed Aug. 11, 1999 entitled "KNOWLEDGE-BASED CASINO GAME AND METHOD THEREFOR" which claims priority to U.S. Provisional Application Serial No. 60/099,959 filed on Sep. 11, 1998 entitled "KNOWLEDGE-BASED CASINO GAME AND METHOD THEREFOR" all of which is incorporated by reference herein.

BACKGROUND OF THE INVENTION

1. Field of the Invention

The present invention relates to casino games and, in particular, to improvements in the methods of playing timed bonus games on an underlying game.

2. Background and Statement of the Problem

The casino-playing public is demanding more sophisticated forms of gambling, especially from slot machines. Slot machines with bonusing are becoming more popular, and a continual need exists to provide new, challenging, and exciting bonuses.

Furthermore, the public's fascination with trivia continues unabashed as television trivia quiz shows continue to be very popular. Some of these shows (e.g., Who Wants to Be a Millionaire?) do not employ timers of any sort, while others (e.g., Jeopardy!) do. Still others utilize elapsed time in determining a contestant's point-total and eliminate answers as a function of time, to encourage contestants to answer early but keep contestants with inferior knowledge in the game.

There exists a continual need to add more challenge, risk and excitement to a casino player's experience. There exists a need to combine casino gaming and quiz trivia in the form of knowledge-based bonus games for an underlying casino gaming device.

Furthermore, there exists a continual desire to limit the temporal length of the bonus game, so as to maximize the house advantage and to minimize moneymaking "down time" of the underlying casino gaming device.

Furthermore, there exists a desire to offer knowledge-based games in which the player who "knows" the answer is rewarded with a greater prize than the player who "guesses" the answer.

SOLUTION TO THE PROBLEM AND DETAILED DESCRIPTION

Figure 1:
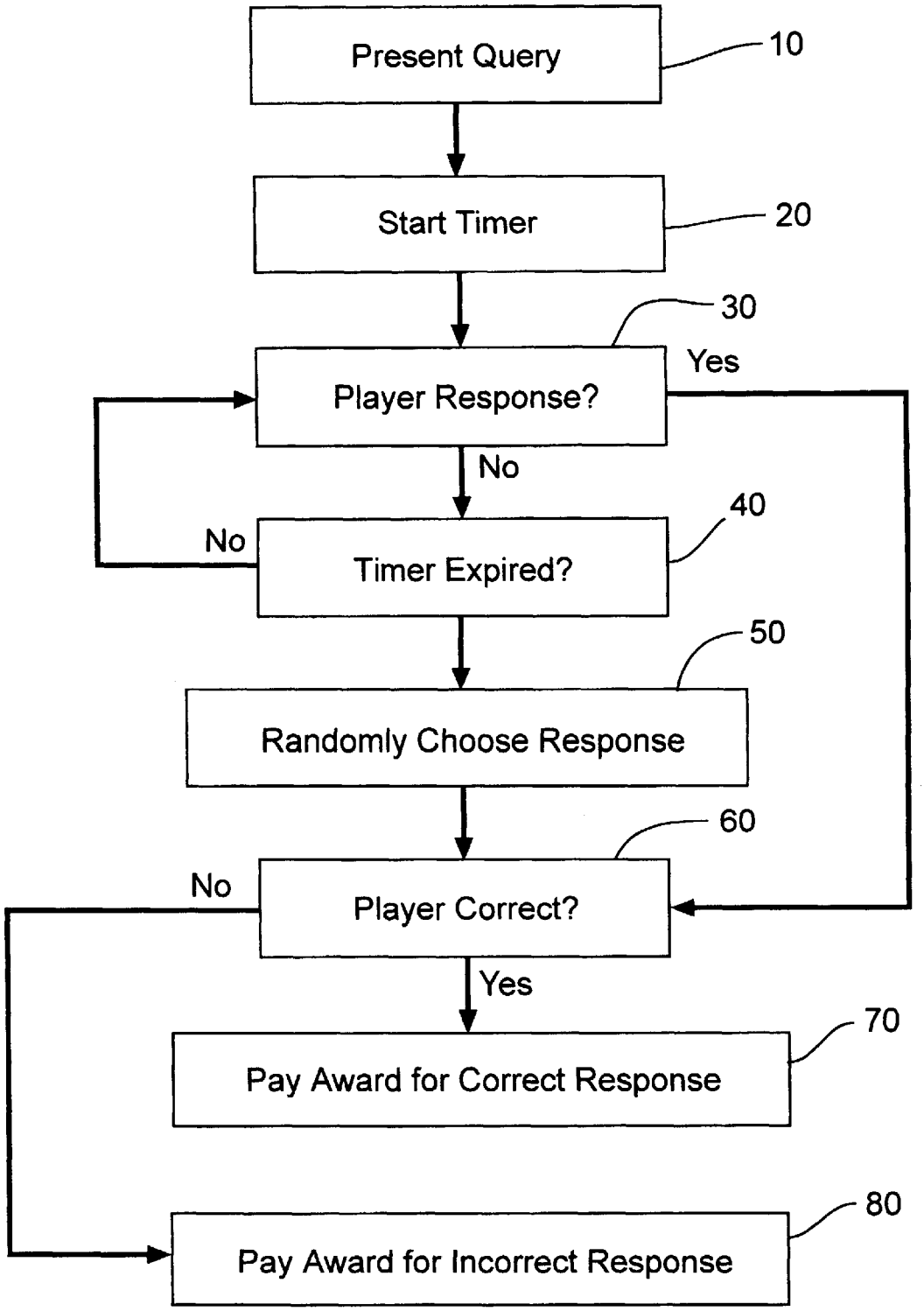
FIG. 1 is a flow chart showing the preferred embodiment method for two responses of playing a temporal knowledge-based game.

The solution, as presented herein, comprises a knowledge-based bonus game and method having a temporal component. The temporal component assumes the form of one or more bonus timers. It is a feature of the present invention that bonus timers may be used in several different ways.

A knowledge-based casino game with bonus timer, under the teachings hereof, works well as a bonus game to a conventional underlying casino game of chance. The bonus timer is best placed as a part of the game computer that includes the rules of play and the questions and answers for playing a knowledge-based casino game. The bonus timer is a typical clock function easily included in the bonus game computer and set to perform the functions described herein for the various iterations of executing the methods of playing the knowledge-based temporal games. The computer can be typically a microprocessor included as part of the underlying or separate for the bonus game. Such microprocessors are common and can be obtained from Sigma Game Inc. of Las Vegas, Nev. set up for the particular functions desired. In this specific instance the microprocessor is capable of and arranged to time responses to queries as set forth through out the disclosure; see FIG. 1 for example.

Consider the following knowledge-based bonus game on an underlying conventional slot machine. The slot machine can be a standard stepper-reel or video-reel, with one or more pay lines, that has a bonus feature. Without loss of generality, assume that with X units wagered in the underlying game, the player is eligible for the bonus game with frequency, f. The frequency, "f", may periodically occur (e.g., every 20 games) or may be entirely random with a statistical frequency over time (e.g., also on average every twenty games, but randomly occurring). The bonus game frequency may in addition be a function of the wager and/or the number of pay lines wagered upon.

Assume the expected rates of return are "R" units for the underlying casino game of chance without the bonus, and the knowledge-based bonus timer bonus participation, on average, garners "B" units. The house advantage may be written as:

$$\text{House Advantage}=-[R+f\,B-X]/X \qquad \text{FORMULA 1}$$

Where:

R=Player's Expected Return for Underlying Game in Units f=Frequency

B=Player's Expected Return for Bonus Game in Units

X=Units Wagered

Of course, the following is true:

$$\text{Player's Expectation}=-\text{House Advantage} \qquad \text{FORMULA 2}$$

When used as a bonus or as a part of a game, the means of initiating the bonus or entering the part of the game is not material to this invention. Any condition occurring in the underlying game of chance can be utilized. There are a large number of bonus game initiation mechanisms that are variously triggered upon the occurrence of an event in the underlying game. For example, in the case of reel slot machines, a special bonus pay symbol (or combination of existing symbols) could align on the payout line (or elsewhere in the window) of the slot machine. Or, any other suitable game event could be utilized such as the occurrence of a random event such as selecting a random number for coin-ins and signaling the condition when the random-numbered coin-in occurs. Any condition occurring, but unrelated to the game play can also be utilized such as a randomly set timer. While the condition preferably causes the underlying game of chance to stop so that the knowledge-based bonus game can be played, certain embodiments of the present continue play of the underlying game of chance while the player plays the knowledge-based bonus game.

In addition, the play of the knowledge-based bonus game could also require an extra wager. For example, when the condition occurs in the underlying game of chance, the player would have a choice to wager an additional amount to play the knowledge-based bonus game or to continue play of the underlying game of chance. The teachings of the present invention are not limited by the condition in which the underlying game of chance triggers, causes, initiates, or trips the play of the knowledge-based bonus game.

The knowledge-based bonus game has a bonus timer and the use of the formulas described above (or something similar) determines the limiting cases of perfect knowledge and no knowledge on the part of the player invention shown in flow chart of the preferred embodiment method for two responses in FIG. 1. As a practical matter the house advantage must be maintained in a predetermined range, as will be described, to make this a casino game.

EXAMPLE

For example, consider a slot machine in which the player (with a line bet, X, of arbitrary units) is eligible for a knowledge-based bonus game of the present invention with frequency, "f", of 0.005 (i.e., 1 in every 200 spins). Furthermore, the expected return R on the conventional underlying casino game is 0.7X units (70%). A player may have perfect knowledge or a player may simply guess the answers to the knowledge-based bonus game with the bonus timer. For the player simply guessing, assume a desired House Advantage of roughly 12% (i.e., Player's Expectation=−12%). Solving Formula 1, the desired $B_{MIN}$= 36×the line bet, or 36X. $B_{MIN}$ is a first value for a player's expected return from pure guessing. For the player with perfect knowledge, a desired "worst case" scenario is no House Advantage or 0%. Setting the House Advantage equal to 0% yields in Formula 1, a $B_{MAX}$=60×the line bet, 60X. $B_{MAX}$ is a second value for a player's expected return for always being correct.

Further assume the following algorithmic game model for the knowledge-based bonus casino game with its bonus timer of this example:

The player in the bonus game is asked 10 a timed knowledge-based question and given 2 possible responses. The player is given 12 seconds 20, 40. If the player responds 30 within 12 seconds and is correct 60, the player is awarded 60×the line bet, in units 70. If the player responds within 12 seconds and is incorrect, the player is awarded 12×the line bet 70, in units. If the bonus time expires 40, a response is randomly selected 50 for the player, who is awarded the appropriate award based on the response being correct or incorrect.

The following considerations are possible for this example. A player with perfect knowledge will always answer correctly and will have an expected win, $B_{MAX}$, for the bonus game=60X units. This player's expectation (and the House Advantage) will be 0% for the entire game. On the other hand, a player that knows none of the answers will either guess or let the bonus timer expire. If the player guesses, he/she will guess correctly one-half the time, and incorrectly one-half the time. This player's expected win, $B_{MIN}$, for the bonus game is ½(60X)+½(12X)=36X units, leading to a player's expectation of −12% (house advantage of +12%), as desired, for the entire game. If the player lets the bonus timer expire, then the player has a one-half chance of randomly being assigned the correct response, and a one-half chance of randomly being assigned the incorrect response, so again the player's expectation is −12% as desired. Therefore, even with the use of an associated bonus timer, the casino is assured of a statistical House Advantage in a range having a predetermined upper limit and a predetermined lower limit.

Note that these two types of players represent the two extremes in terms of the knowledge-based casino game play of the design and method of the present invention. All other players, with perhaps knowledge of some of the answers, or some knowledge of the answers, will have player expectations that fall, in this example, between the two extremes of 0% and −12% House Advantage. Or, house advantages in the range of 0% (for perfect knowledge players) to 12% (for players who simply guess or let the bonus timer expire).

The actual values of 0% and −12% in this example are mere illustrations based on the two types of players: a player with perfect knowledge and a player with no knowledge (i.e., a player simply guessing or "leaving it up to chance"). All other players will fall somewhere in the middle of the range. The "average" house advantage for the combined underlying game of chance and knowledge-based bonus game will fall somewhere in the middle of the range dependent upon the knowledge of that player.

In the first embodiment just described, the bonus timer may be used simply to limit the length of time a player has to answer the knowledge-based question. For example, after a question and the possible answers have been presented, an on-screen clock device or illustrative bonus timer may be depicted and counted down, after which the response-time is over. In lieu of, or in addition to, a pictorial depiction of the time remaining, an accompanying musical selection of appropriate duration may be used which, upon ending, concludes the response-time. It is to be expressly understood that the use of the bonus timer need not imply a physical timepiece or other visual or audio metric apparent to the player. Although, the preferred embodiment has the bonus timer begins after the query has been presented. It is also possible to have the bonus timer begin at other arbitrary points, for example before the query has been presented, or after the player has signaled that he/she has read the query, and so forth.

In this embodiment, provided that the player answers 30 within the allotted time 20, 30 the award 70, 80 is subject only to the accuracy of the response 30. Thus, the player may answer immediately, or wait until the bonus timer has almost expired, and still be awarded an amount commensurate with the response and not the elapsed time.

If the bonus timer does expire, then there exists a design and method step choice of the player as to how the gaming is to proceed. In a preferred embodiment described above, the player is simply provided with a random response 50, and is awarded based on the accuracy of the randomly selected response 70, 80. This affords players who run out of time the opportunity to still get the correct answer, if they are fortunate enough to have the random response be a correct answer.

In another embodiment, the player is awarded an amount equal to having answered incorrectly. This forces the astute player to guess before the bonus time expires 40, since otherwise the result is equivalent to an incorrect response. Thus, the expectations for perfect-knowledge players and those that merely guess remain as before, equal to 0% and −12% respectively.

While it is assumed that players will try to maximize their expected return, B, in the play of the bonus games. It is to be expressly understood that it is possible for a player having perfect-knowledge to purposely attempt to miss every knowledge-based question. It is also possible for such a player to purposely let the bonus timer expire, i.e. equivalent to always getting the response incorrect. In that case, the player's expectation for this example would be −24%.

Alternatively, the player may be awarded an amount equal to expected value from guessing the answer. In particular, in the first preceding example, a player who guesses has a ½ chance of being correct and a ½ chance of being incorrect. Hence, the expected value EV from guessing is ½×60X units+½×12 units=36X units, where again, X is the line bet. In this case as well, the expectations for perfect-knowledge and no-knowledge remain equal to 0% and −12%, respectively.

The use of a bonus timer in this fashion has several benefits, among them added, challenge and suspense due to a sense of urgency in the bonus round. If the underlying gaming device were a slot machine, it also would most likely lead to increased wagering due to the limited length of the bonus round. Typical bonus rounds are considered "down time" in that no additional wagering takes place. Hence, accelerating bonus round play (in which players do not wager) potentially leads to more rapid resumption of play for the base or underlying game (in which players do wager).

In each of the examples given, from a game design point of view, the use of the bonus timer would not change the expected value of the bonus game for either a player with perfect knowledge or a player with no knowledge. As a result, the player's expectation and house advantage, too, remain unchanged.

In a second preferred form of the timed bonus round, the bonus timer is used not only to limit the length of bonus play (time to answer the query), but also to determine the actual award the player receives. As an illustrative example, consider the following query:

By area, what is the largest state in the USA?

(a) Alaska
(b) Montana
(c) California

A bonus timer is initiated at 15 seconds. A correct answer is worth 50 credits plus the number of seconds remaining (rounded up to the nearest second) multiplied by 10. An incorrect answer is worth 50 credits. In this manner, a player who knows the answer, and responds almost instantly, will be awarded 50 credits+15 seconds×10 seconds=200 credits. A player who answers correctly, but after some time has elapsed (i.e., between 1 second and 15 seconds), will win a lesser award between 60 credits and 190 credits. A player who guesses incorrectly (or runs out of time) will be awarded only 50 credits, regardless of how much time was taken.

In this manner, the bonus timer adds additional challenge, risk and suspense in that there is an incentive for the player to respond quickly to the query. The award for answering correctly is thus related, generally inversely, to the time elapsed when responding. That is, the shorter the player requires to respond, the greater the potential award, and the longer the player takes to respond, the less the potential award.

From a game developing point of view, the use of this type of bonus timer influences the limiting cases of perfect and no knowledge in the following fashion. The calculation must include an assumption that the player will answer instantly as in the case of perfect knowledge. Hence, a player with perfect knowledge has a bonus-game expected value $B_{MAX}$=200 units. For optimal play a player with no knowledge, it would be financially best to respond instantly, so that if correct, the maximum award is obtained. Hence the no-knowledge associated bonus-game expected value $B_{MIN}$=⅓×200 units+⅔×50 units=100 units. Additionally, a worst-case player, who simply lets time run out, has an associated B=50 units.

The foregoing is meant as an illustrative example, not only in the form of the query, but in the numerical values thereby assigned. Clearly, a player who does not answer (and hence, runs out of time) could be handled in a different manner, such as by the teachings presented earlier. Too, the nature of the relationship between time elapsed and award is a design choice. In particular, as an alternative form of this bonus, the player could receive a higher award for responding quickly, whether correct or incorrect.

As yet another alternative, in conjunction with the player receiving less of a potential award as time ticks away, incorrect responses may be automatically removed. In this fashion, an unsure player may wait (albeit with less of a potential award) because the incorrect responses are eliminated, say, one by one, in accord with the elapsing time.

As an example, consider the following query:

How tall was the world's tallest man?

6' 11"
7' 11"
8' 11"
9' 11"

The following serves to illustrate the embodiment. The player is given the query and possible responses. A 20 seconds bonus timer is implemented. If, at any time, the player responds incorrectly, the bonus is over and the player is awarded 50 credits. If the player responds correctly within 5 seconds, he/she is awarded 250 credits. If no response has occurred by 5 seconds, then one of the incorrect responses is eliminated. If the player responds correctly between 5 and 10 seconds, he/she is awarded 200 credits. If no response has occurred by 10 seconds, a second incorrect response is eliminated. If the player responds correctly between 10 and 20 seconds, he/she is awarded 150 credits. If time runs out, the player is given a random response from among the two remaining responses.

The perfect-knowledge player has $B_{MAX}$=250. The no-knowledge player has the following expected values, as a function of time elapsed prior to responding:

| | |
|---|---|
| T < 5 seconds | ¼ × 250 + ¾ × 50 = 100 |
| 5 <= T < 10 | ⅓ × 200 + ⅔ × 50 = 100 |
| 10 <= T < 20 | ½ × 150 + ½ × 50 = 100 |
| 20 <= T | ½ × 150 + ½ × 50 = 100 |

Thus, regardless of strategy used as to time elapsed, the no-knowledge player has $B_{MIN}$=100 units.

Note however, that this is a design choice. If instead, the potential award for responding correctly between 5 and 10 seconds were 175 units or credits (instead of 200 credits), then the associated expected value in that time interval would be ⅓×175+⅔×50=91.67. A no-knowledge player, then, would be better served answering in the first 5 seconds or after 10 seconds, with an associated $B_{MIN}$=100. The worst-case expected value of B, which may be utilized for calculating a worst-case player's expectation, is equal to 91.67 in this case.

While the foregoing has been illustrated by eliminating incorrect answers, several such representations are equally valid and will be appreciated by those skilled in the art. For example, the illumination of one of the incorrect responses may be dimmed (or erased or crossed-out or otherwise shown to be incorrect). For multiple-choice queries, multiple incorrect answers may thus be made known to the player, either concurrently or sequentially as a function of time elapsed.

In the most preferred embodiment for multiple-choice queries, multiple bonus timers are employed and the player is allowed to respond either until correct or until only one answer remains. Consider the following query:

What is the smallest planet in our solar system?

Mercury
Earth
Neptune
Pluto

The following illustrates the logical flow of the bonus game. The player is given a bonus timer of 12 seconds and awarded 200 credits if correct on the first guess (regardless of elapsed time). If time expires, a response is randomly chosen. If incorrect, the bonus timer resets to 12 seconds, and the player is given 150 credits if correct on the second guess (regardless of elapsed time). If time expires, a response is randomly chosen. If incorrect a second time, the bonus timer resets to 12 seconds, and the player is given 100 credits if correct on the third guess (regardless of elapsed time). If time expires, a response is randomly chosen. If not answered or answered incorrectly a third and final time, the player is awarded 50 credits since the only unselected response was the correct answer.

From a design point of view, the foregoing example results in a perfect-knowledge $B_{MAX}$=200 credits, and a no-knowledge $B_{MIN}$=¼×(200 credits+150 credits+100 credits+50 credits)=125 credits.

As before, the foregoing is meant to be illustrative, and is not intended to limit the teachings of the invention. But as can be appreciated, the use of multiple bonus timers ensures that progress is made in the bonus game, even if the player is afforded multiple responses in the case of incorrect responses. Multiple bonus timers may also be utilized in a manner in which the award is a function of the time elapsed.

A method for playing a knowledge-based bonus game on an underlying game of chance has steps of presenting the player with a query; limiting the time in which the player may respond to the query; awarding the player a greater award if the player is correct, and a lesser award if the player is incorrect, and limiting the amount of the awarding for the combined knowledge-based bonus game with the underlying game of chance so a house advantage remains within a predetermined range.

Another method has the steps of receiving a wager; playing an underlying game of chance; playing a time-limited knowledge-based bonus game in combination with the underlying game, and limiting the amount of the awarding for the combined knowledge-based bonus game with the underlying game of chance so a house advantage remains within a predetermined range.

A further method has the steps of presenting the player with a query; limiting the time in which the player may respond to the query; awarding the player a greater award if the player is correct, and a lesser award if the player is incorrect; randomly choosing a response for the player should the time limit be exceeded, and limiting the amount of the awarding for the combined knowledge-based bonus game with the underlying game of chance so a house advantage remains within a predetermined range.

Still another method has the steps of presenting the player with a query; limiting the time in which the player may respond to the query; awarding the player a greater award if the player is correct, and a lesser award if the player is incorrect or if the time limit is exceeded, and limiting the amount of the awarding for the combined knowledge-based bonus game with the underlying game of chance so a house advantage remains within a predetermined range.

Yet another method has the steps of presenting the player with a query; limiting the time in which the player may respond to the query; awarding the player who responds correctly in a manner generally inverse to the time elapsed, and limiting the amount of the awarding for the combined knowledge-based bonus game with the underlying game of chance so a house advantage remains within a predetermined range.

One other method for playing a knowledge-based bonus game on an underlying game of chance comprising the steps of presenting the player with a query and at least two possible answers; limiting the time in which the player may respond to the query; eliminating at least one answer after a portion of time has elapsed; awarding the player who responds correctly in a manner generally inverse to the time elapsed, and limiting the amount of the awarding for the combined knowledge-based bonus game with the underlying game of chance so a house advantage remains within a predetermined range.

Then one more method has the steps of presenting the player with a query; limiting the time in which the player may respond to the query; awarding the player a greater award if the player is correct, and answers within the time limit lesser award if the player is incorrect and/or answers after the time limit, and limiting the amount of the awarding for the combined knowledge-based bonus game with the underlying game of chance so a house advantage remains within a predetermined range.

The step of presenting the player with a query includes limiting the award based on time taken to answer. The limiting step includes presenting multiple choice answers. The step of presenting is further limited by removing wrong answers and decreasing the award accordingly. The step of limiting the time to answer has the step of beginning the bonus timer when the question is presented, beginning the bonus timer after a signal from the player that the question has been read or at any arbitrary point.

The foregoing is meant to illustrate the teachings and is not meant to limit the scope of the invention disclosed herein. Those skilled in the art will appreciate variations to the methods and embodiments. The method includes the step of limiting the amount of the awarding for the combined knowledge-based bonus game with the underlying game of chance so a house advantage remains within a predetermined range or its equivalent. Thus, the scope of the invention should be considered in conjunction with the appended claims.

What is claimed:

1. A method for playing a casino game comprising:

presenting to a player of the casino game a query having a plurality of responses, starting a time period, receiving, in the casino game, from the player a response selected by the player from the plurality of responses before the time period expires, when no response is received from the player before the time period expires, randomly choosing in the casino game a response from the plurality of responses, paying the player a higher award for a correct response to the query when received from the player or when randomly chosen by the casino game, paying the player a lower award for an incorrect response to the query when received from the player or when randomly chosen by the casino game.

2. The method of claim 1 wherein starting the time period occurs before presenting the query to the player.

3. The method of claim 1 wherein starting the time period occurs after presenting the query to the player.

4. The method of claim 1 wherein starting the time period further comprises:

receiving a signal from the player to start the time period.

5. The method of claim 1 wherein presenting the query to the player occurs at a frequency during play of an underlying casino game of chance in the casino game.

6. A method for playing a casino game comprising:

presenting to a player of the casino game a query having a plurality of responses, receiving, in the casino game, from the player a response selected by the player from the plurality of responses before a time period expires, eliminating an incorrect response in the plurality of responses, when no response is received from the player before the time period expires, receiving from the player another response selected by the player in response to eliminating an incorrect response, paying the player a higher award for a correct response when received from the player during the time period, paying the player a lower award for a correct response when received from the player after the time period expires.

7. The method of claim 6 wherein when no response is received from the player in a second time period after the time period randomly, choosing a response and paying the player the lower award for a correct response when randomly chosen.

8. The method of claim 6 wherein receiving from the player another response, said another response is received from the player before a second time period expires.

9. The method of claim 6 wherein presenting the query to the player occurs at a frequency during play of an underlying casino game of chance in the casino game.

10. A method for playing a casino game having an underlying game of chance and a bonus game comprising:

playing the underlying game of chance, entering the bonus game at a given frequency during all play of the underlying game, the bonus game comprising:

presenting to a player of the casino game a query having a plurality of responses, starting a time period, receiving, in the bonus game, from the player a response selected by the player from the plurality of responses before the time period expires, when no response is received from the player before the time period expires, randomly choosing in the bonus game a response from the plurality of responses, paying the player a higher award for a correct response to the query when received from the player or when randomly chosen by the casino game, paying the player a lower award for an incorrect response to the query when received from the player or when randomly chosen by the casino game.

* * * * *